United States Patent [19]

Wallace

[11] 4,351,121

[45] Sep. 28, 1982

[54] SNOWSHOE

[76] Inventor: Robert E. Wallace, 12881 Foothill La., Saratoga, Calif. 95070

[21] Appl. No.: 150,842

[22] Filed: May 13, 1980

[51] Int. Cl.[3] ..... A43B 5/04

[52] U.S. Cl. ..... 36/125

[58] Field of Search ..... 36/122, 123, 124, 125

[56] References Cited

U.S. PATENT DOCUMENTS 2,821,031 1/1958 Howe ..... 36/125

3,965,585 6/1976 Stewart ..... 36/125

3,992,790 11/1976 Frye ..... 36/125

*Primary Examiner*—Patrick D. Lawson

*Attorney, Agent, or Firm*—David A. Boone

[57] ABSTRACT

A one-piece light metal alloy snowshoe is coupled to a boot attached to a crampon/binding assembly via a fixed pivot assembly. A quick lock-release device of the crampon/binding assembly may be adjusted to accommodate any size boot. Thereafter, the simple moving of a locking-release lever will firmly attach and release the boot to the crampon assembly and the snowshoe.

9 Claims, 24 Drawing Figures

SNOWSHOE

BACKGROUND OF THE INVENTION

Snowshoes have been used for many years to traverse stretches of deep snow or ice whether for work or sport purposes. The design of snowshoes, however, has discouraged more general use because they are awkward to operate, difficult to attach to the boot and have a great tendency to slip backward or sideways on steep slopes. They are also difficult to maintain because of the materials used.

Present typical designs of snowshoes utilize wood frames with leather strips for webbing and the boot is attached to the snowshoe with a complicated binding arrangement of thongs, buckles and straps. Because of the snowshoe shape and loose bindings, these prior designs provided inadequate control over movement of the snowshoe and hence were very difficult to maneuver. Also the materials used required frequent care and upkeep. For example, the wood frames and leather webbing require frequent varnishing to reduce abrasion wear and, particularly, stretching of the leather components due to the absorption of water. Some recent designs incorporated synthetic materials for webbing but have similar problems with abrasive wear.

Prior snowshoes failed to prevent slipping on both uphill and sidehill traversing, especially on hard or icy snow. All-plastic snowshoes proved to be even more slippery and were much weaker than the wood and leather snowshoes they succeeded.

Of particular annoyance to snowshoe users has been the fact that these prior art designs required the use of the bare hands to manipulate the complicated plastic or leather bindings used to attach the boots to the snowshoes. The problem was aggravated at low temperatures and could be injurious to the user.

SUMMARY OF THE INVENTION

In accordance with the preferred embodiment of the present invention, a one-piece light metal alloy snowshoe is attached via a pivot assembly to a quick release binding and crampon assembly. The crampon assembly is adjustable to accommodate virtually any size or shape boot through a few simple adjustments. Once adjusted, the simple movement of the quick lock-release lever is all that is required to firmly attach the boot to the crampon/binding assembly and hence to the snowshoe. This may be accomplished with mittened hands in cold weather. The entire crampon/binding assembly is easily attached and removed from the snow shoe by the placement and removal of a rigid pivot bar which couples the crampon/binding assembly to the snowshoe. (In addition an accessory heel crampon can be added to the crampon/binding assembly to be used without the light metal alloy snowshoe on very steep ice and hard snow.) The preferred embodiment has the advantage that it greatly reduces the danger of slipping sideways on steep and icy sidehill traverses. Also uphill traction is greatly improved due to the toe crampon design by which front points extend beyond the toe of the boot thus providing a greater "bite" into the snow. The binding is simply released by depressing a locking spring member by hand, or even with a ski pole or similar object from a standing position. The complete assembly is comprised entirely of high strength metals not easily damaged by rocks and moisture commonly encountered.

DESCRIPTION OF THE PREFERRED EMBODIMENT

Figure 1:
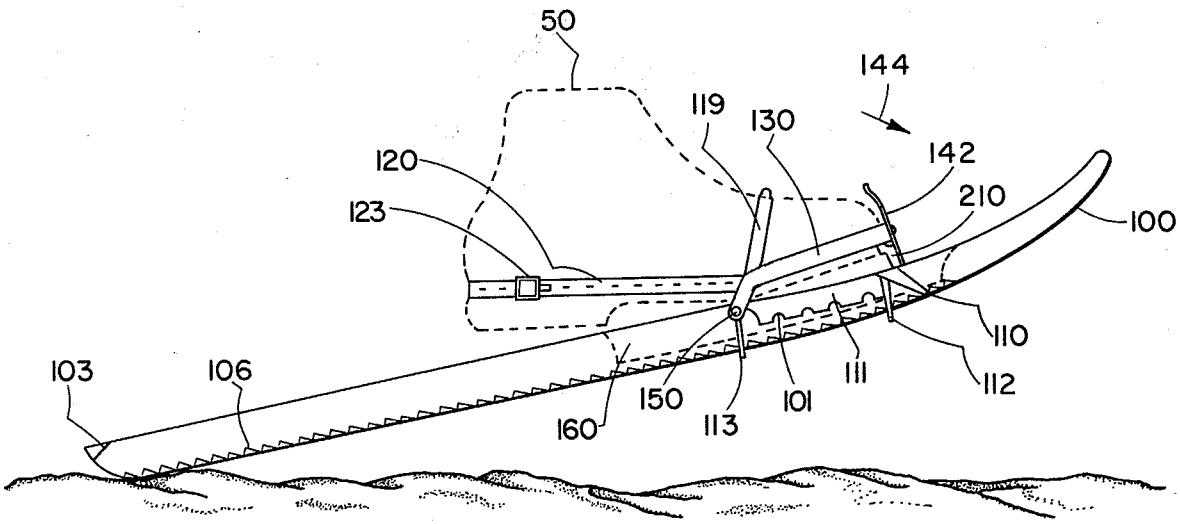
FIG. 1 is a side view showing the binding assembly attached to the snowshoe as the wearer of the snowshoe takes a step forward.

Referring now to FIG. 1, there is shown a snowshoe 100 which comprises a single piece of lightweight metal alloy formed into a snowshoe. Serrations 106 are formed on the edges of the snowshoe and the periphery of the foothole 160 that contact the snow. These serrations 106 provide for improved cutting and gripping action. Also the rear portion 103 of snowshoe 100 is depressed downward to provide resistance to backward slippage.

The snowshoe 100 is coupled to a crampon/binding assembly via a fixed pivot comprising hinge pin 150.

The crampon/binding assembly comprises a locking lever arm 130, a heel band loop 120, a toe band 119, a toe spring member 142, and toe crampon.

The boot 50 is held in the crampon binding assembly by the toe clip assembly 210 which grips the sole of the boot in the toe area and by heel loop 120 which encircles the boot about the heel area.

Toe crampon 111 is formed from a high strength alloy steel and comprises elongated front and rear projections or "points" 110, 112 and 113 for providing extra biting action into ice and hard snow. Smaller side lateral teeth such as 101 are provided to enhance resistance to lateral movement of the crampon.

Figure 8:
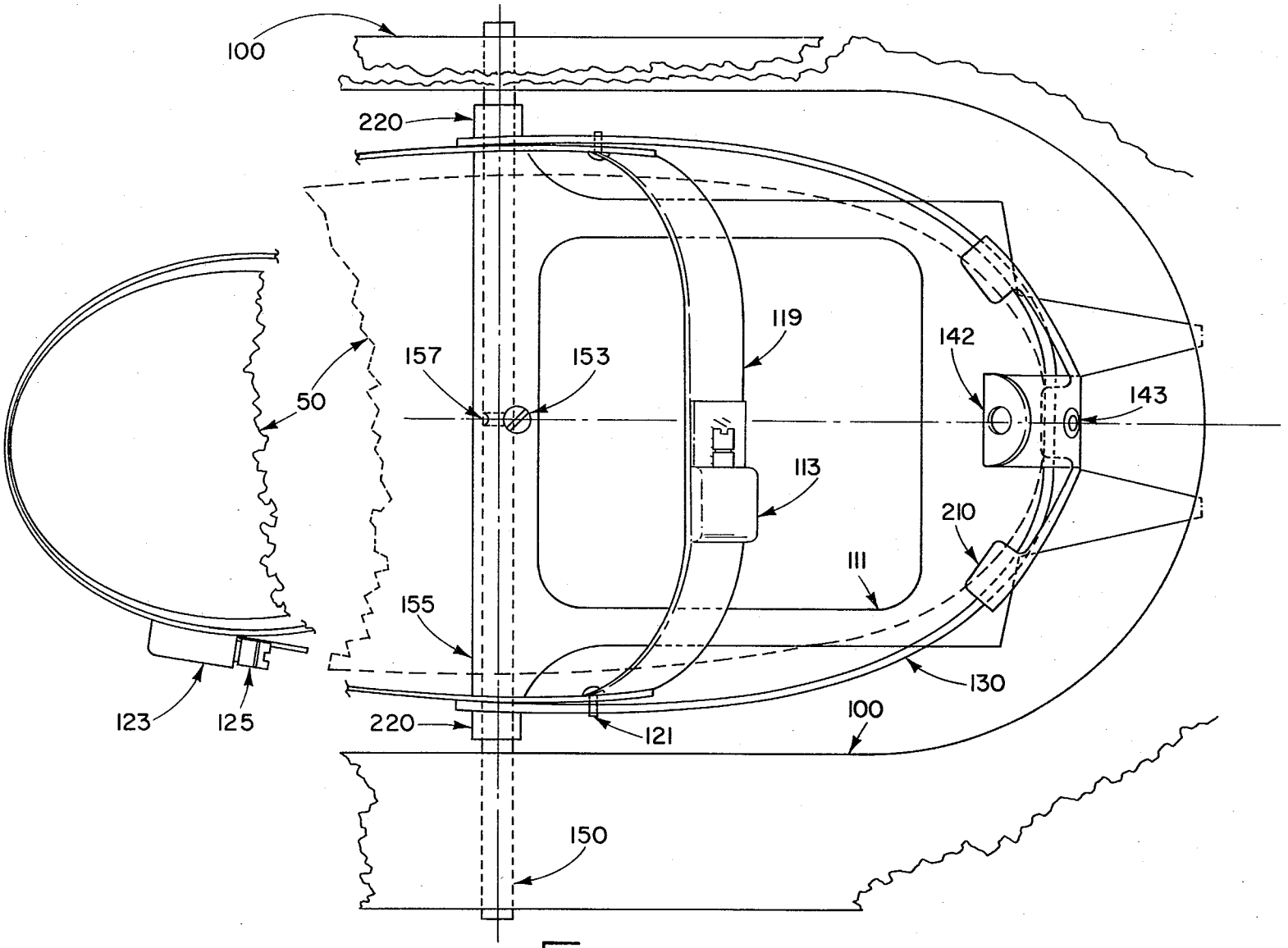
FIG. 8 is a top view of the crampon/binding assembly in the locked position.

A hinge 55 is formed at the rear of the toe crampon 110, and hinge pin 150 passes through hinge 155 and through holes 152, 153, 161 and 162 provided in snowshoe 100 and the pin is secured by a retainer screw 153 which mates with a groove 157 in pin 150 as is shown more clearly in the top view of FIG. 8, The crampon binding assembly is therefore firmly attached by hinge pin 150 to the snowshoe 100. The snowshoe and crampon/binding assembly are secured together since hinge pin 150 cannot be removed once retainer screw 153 is properly in place.

Spring member 142 extends upward in front of and above the toe of the boot and contains a hole (or detent) 143 near boot-toe level. Locking pin 140 projects from the forward most point of locking lever 130 so that when locking lever 130 is rotated sufficiently forward, pin 140 enters the hole or detent 143 of spring member 142, and the crampon assembly is then in the locked position. Locking pin 140 may be released from spring member 142 by providing sufficient downward pressure on spring member 142 in the direction shown by arrow 144 to cause locking pin 140 to be released from the hole or detent 143 in spring member 142. These two simple operations are all that are required to lock and release, respectively, the crampon/binding assembly to the boot.

Note that the forward movement of locking lever 130 towards the position to allow locking pin 140 to enter the locking hole within spring member 142 simultaneously causes the forward movement of heel band loop 120 and the downward motion of toe band 119. This forward motion caused the heel band loop to firmly engage the heel of the boot and force the toe into the toe clip as the downward motion of the toe band restrains the toe from lighting. Conversely, it should be noted that the upward movement of lever arm 130 will cause band loops 120 and 119 to move in the opposite direction and disengage from the heel and toe, respectively, of the boot. The design of the preferred embodiment is such that in the forward or locking position the boot is firmly held to the crampon/binding assembly. In the unlocked position with the locking lever disengaged from spring member 142 and rotated upward the preferred embodiment is designed so that there will be sufficient free space between the bank loops 120 and 119 and the boot 50 such that the boot may be easily disengaged from the crampon/binding assembly.

Portions of band loops 120 and 119 are slotted. Adjustment of the band loops 120 and 119 is provided by band adjuster assembly 123 and 113 respectively. Adjuster 123 and 113 operates in the following manner: Rotation of a screw member therein causes the band loop to lengthen or shorten in the same way metal hose clamps grip radiator hose assemblies and the like. Adjustment of the sizes of the band loops 120 and 119 is made such that the band loops firmly engage the boot 50 when the locking lever is placed in the locking position, i.e., locking pin 140 engages the hole within spring member 142.

The crampon binding assembly is free to rotate through an opening 160 in snowshoe 100. Rotation is, of course, about hinge pin 150.

Note that band loops 120 and 119 attach to locking lever 130 at a connection point which is a preselected distance from hinge pin 150. It is this moment arm provided between hinge pin 150 and attachment point 121 that is designed to provide the desired tightening and loosening travel of band loops 120 and 119 between the locking and unlocked positions of lever arm 130.

Figure 2:
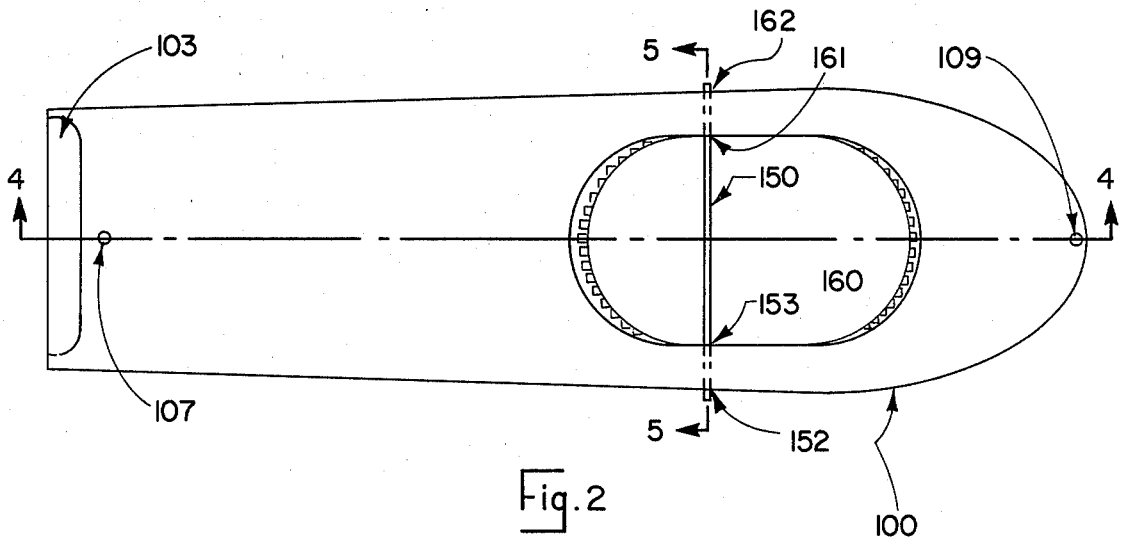
FIG. 2 is a top view.
Figure 3:
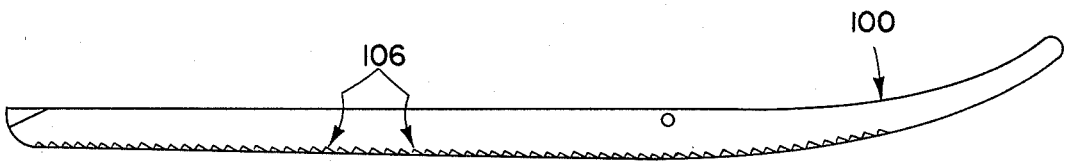
FIG. 3 is a side view and FIG. 4 is a sectional view of the snowshoe of the preferred embodiment.
Figure 4:
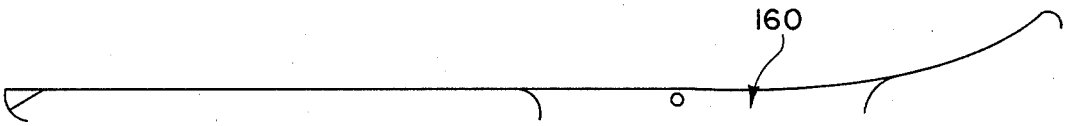
Figure 5:
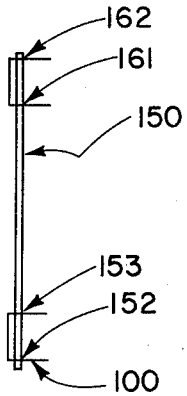
FIG. 5 is a section through the pivot pin.

Referring now to FIG. 2, there is shown a top view of the snowshoe assembly. As mentioned above the snowshoe is formed from a single piece of light alloy metal. The rear portion 103 of snowshoe 100 is sloped downward to provide for resistance to backward slipping during use. Holes 109 and 107 are provided to allow the hanging and storage of the snowshoes when not in use. Note that foothole 160 through the center of the snowshoe allows the toe of the snowshoe to travel through the snowshoe when it pivots about hinge 150.

It should be noted that the heel of the boot cannot travel down through the hole 160.

Figure 6:
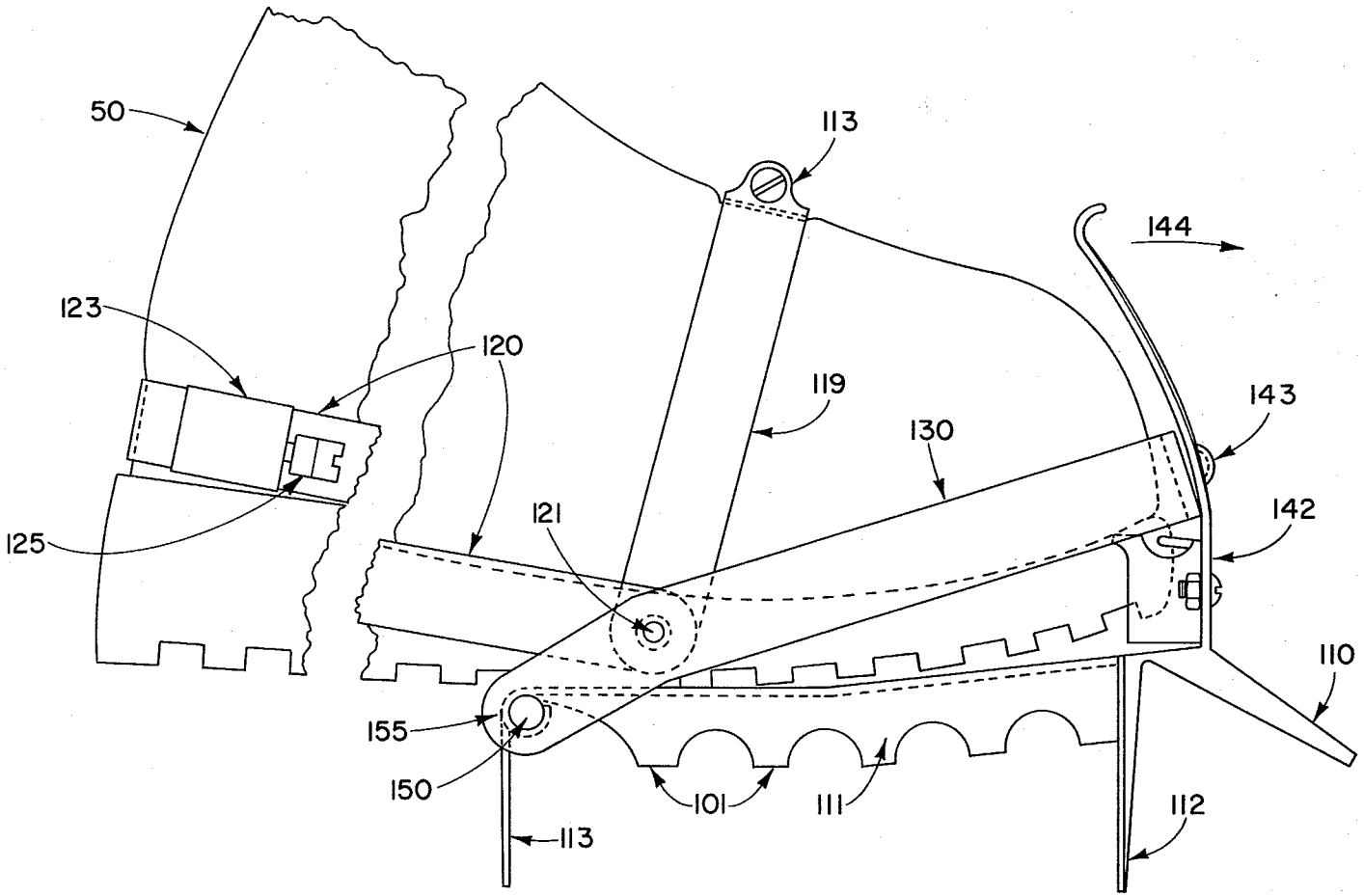
FIG. 6 is a side view of the crampon/binding assembly attached to a boot with the locking lever in the locked position.
Figure 7:
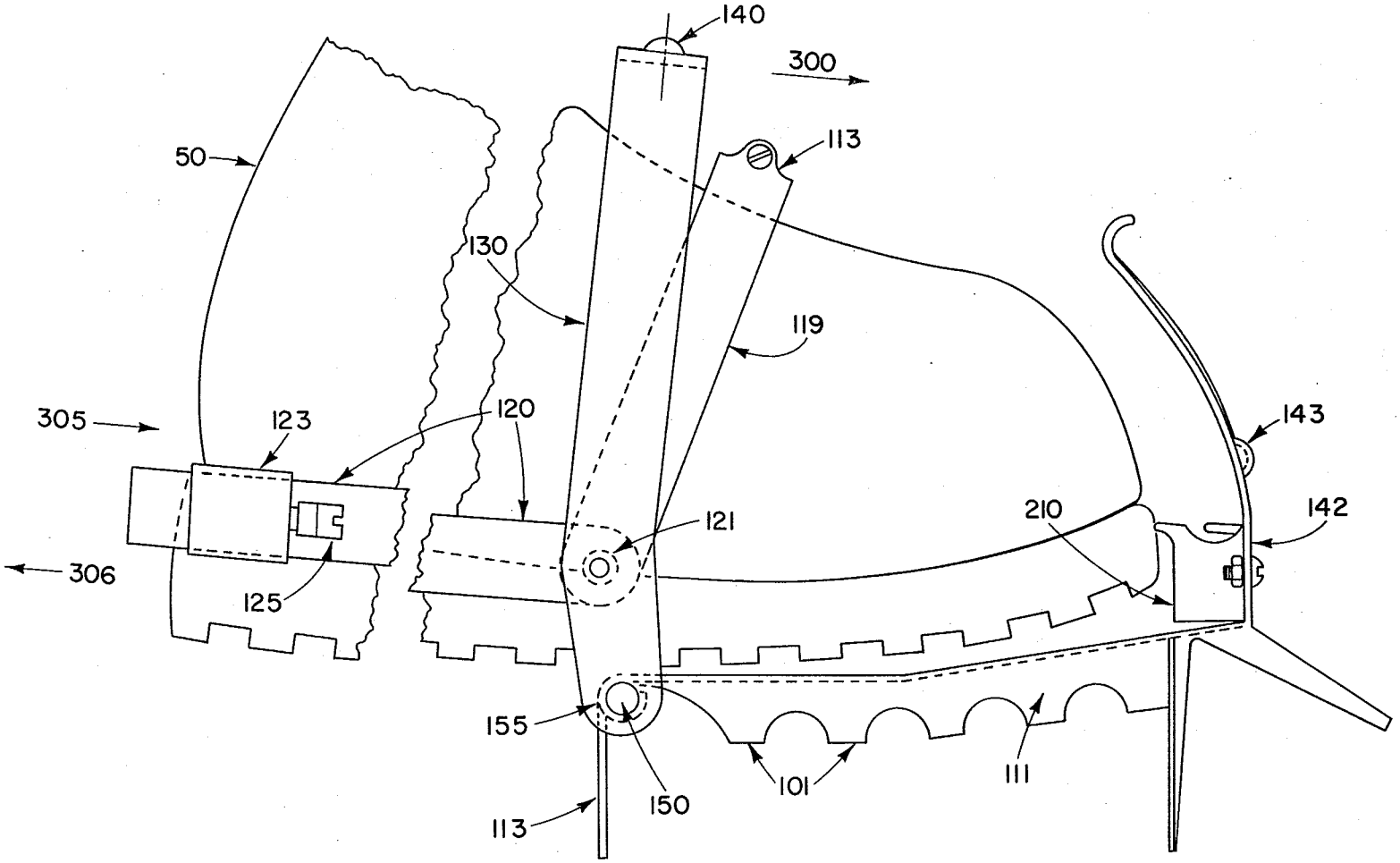
FIG. 7 shows the crampon/binding assembly and boot in the unlocked position without the snowshoe.

Referring now to FIG. 7 there is shown a boot 50 which has been inserted within the crampon binding assembly but which has not been locked in place. In a typical operation the toe of the boot is first placed in the boot sole toe clip 210. Toe clip 210 is made of soft steel and may be bent by the fingers or pliers to conform to the shape of the boot about the toe area. If proper adjustment of heel band 120 has been made the simple downward and forward rotation of locking lever 130 in the direction shown by arrow 300 will cause heel band 120 to be brought forward in the direction shown by arrow 305 and as locking pin 140 reaches and engages hole or detent 143 within spring member 142 the heel band loop 120 will have firmly and snugly engaged the heel of boot 50, thus holding it firmly in place in the crampon/binding assembly. If the boot is not firmly held band loop 120 may be tightened by rotating adjusting screw 125 in adjuster 123. If the band loop is too tight it should be loosened via the rotation of adjusting screw 125 in adjuster 123. Toe band loop 119 should be adjusted in the same manner. Note, however, that once the band loops are properly adjusted for any particular size and shape boot no further adjustment will be necessary. Adjustments are made for wider boots by moving spacers 220 from the outside of locking lever 130 to the inside, thus spreading the locking lever for boot clearance. This operation of the crampon/binding assembly locking mechanism is further illustrated in FIGS. 8 and 6, which are a top and side view respectively of the crampon/binding assembly in the locked position.

Figure 9:
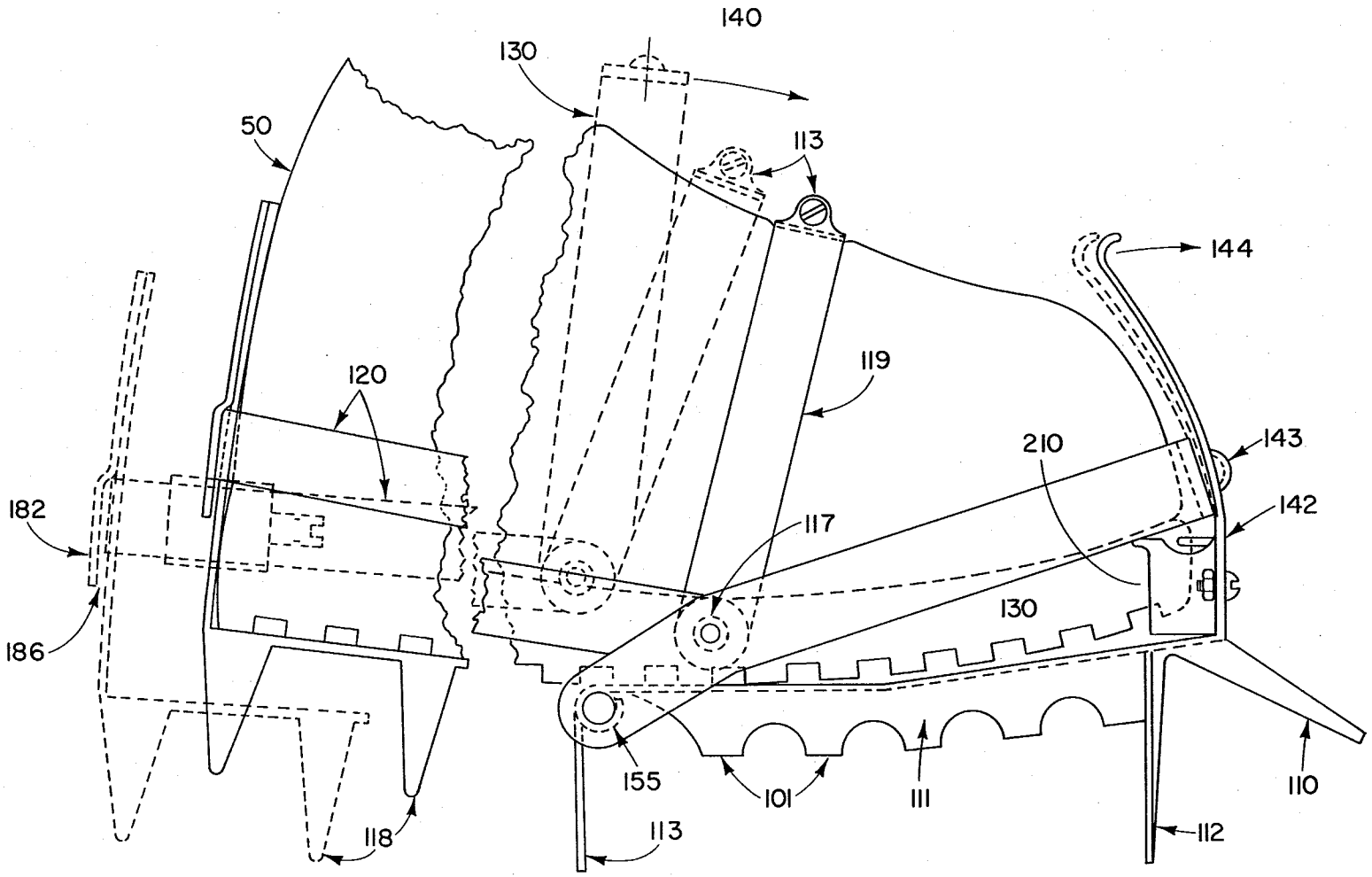
FIG. 9 is a side view of the crampon/binding assembly attached to a boot with the locking lever in the unlocked position in solid line and unlocked position in dashed line. In this embodiment a heel crampon is also shown.
Figure 10:
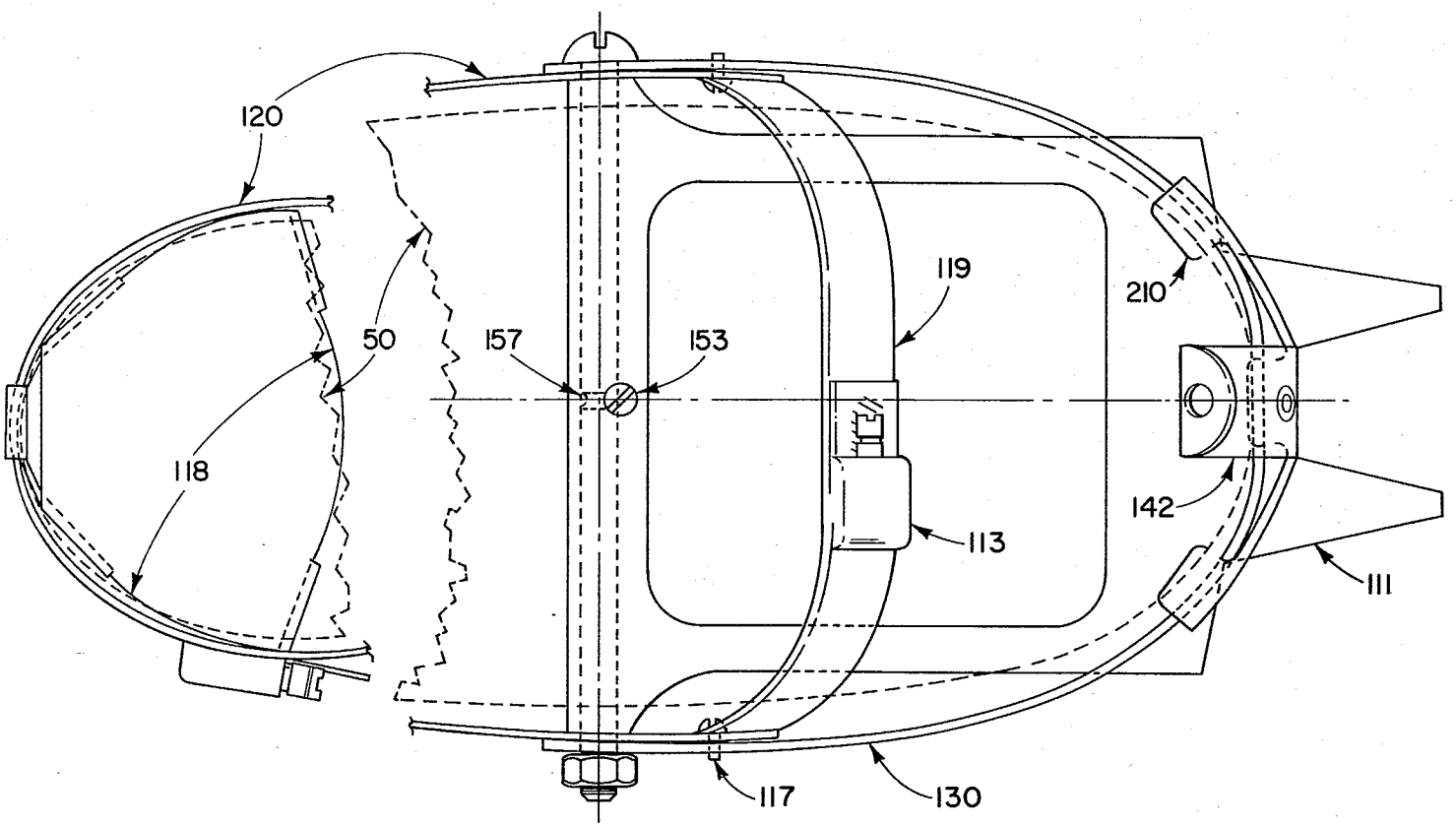
FIG. 10 is a top view of the front and rear portion of the crampon/binding assembly showing the locking lever and heel crampon in a locked position.
Figure 11:
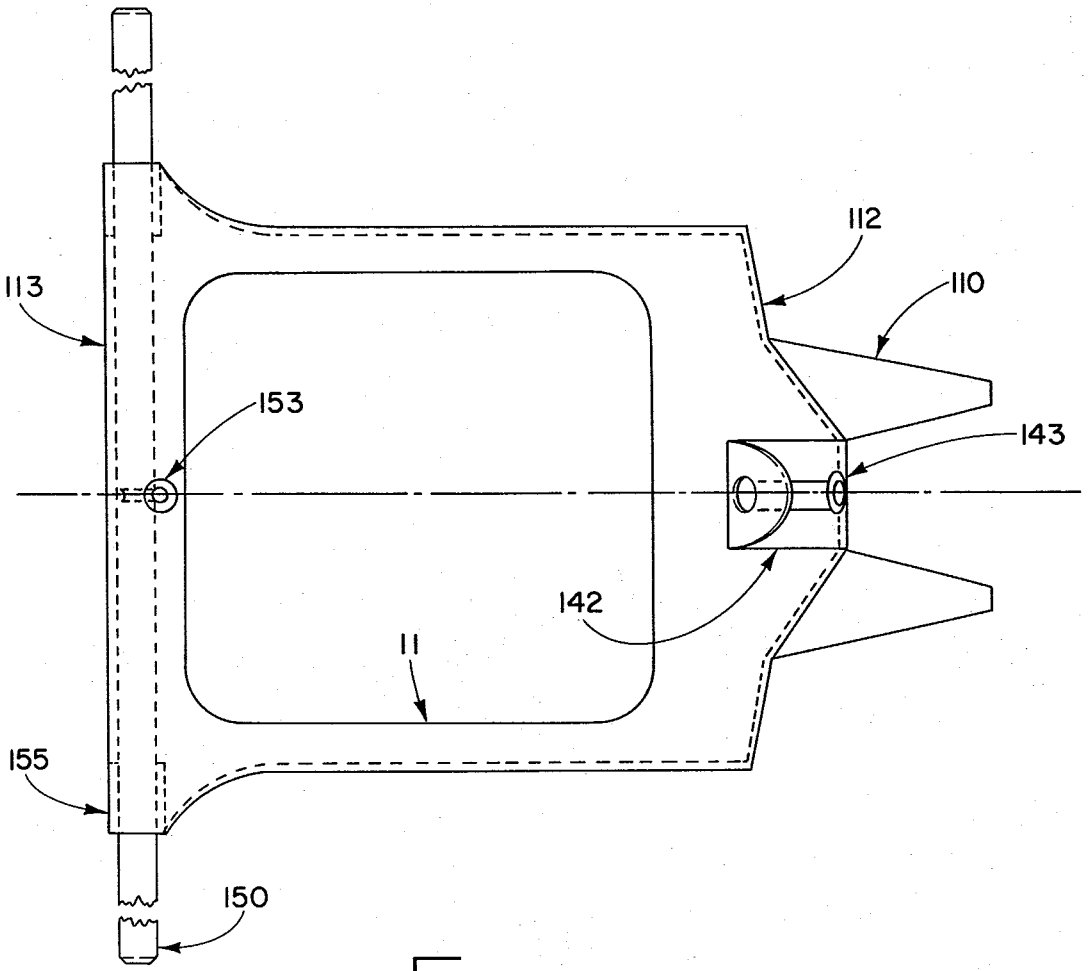
FIG. 11 is a top view.
Figure 13:
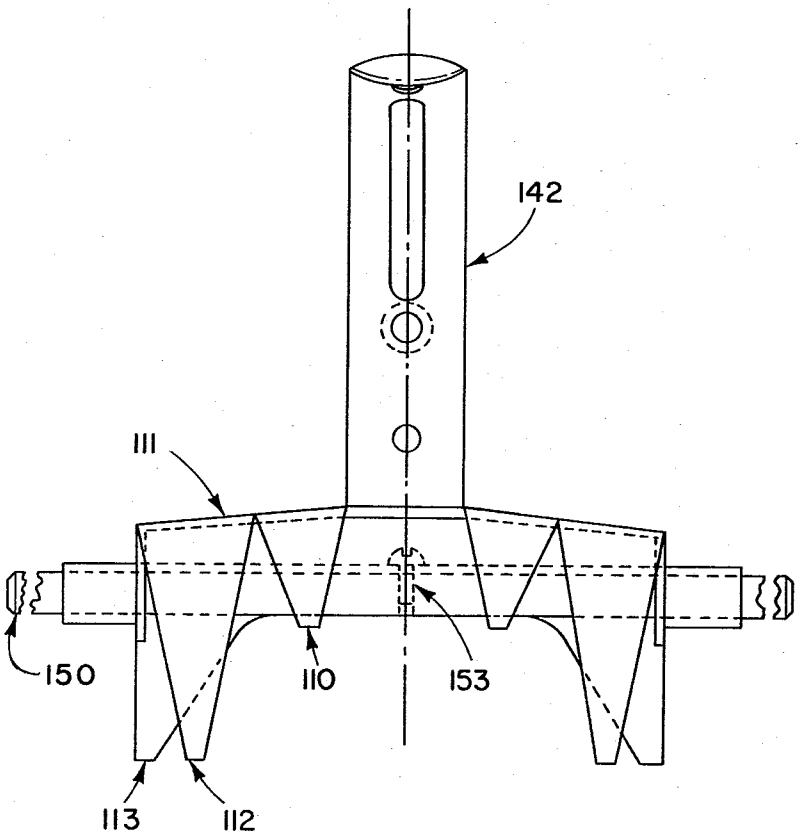
FIG. 13 is a front view of the toe crampon assembly of the preferred embodiment.
Figure 12:
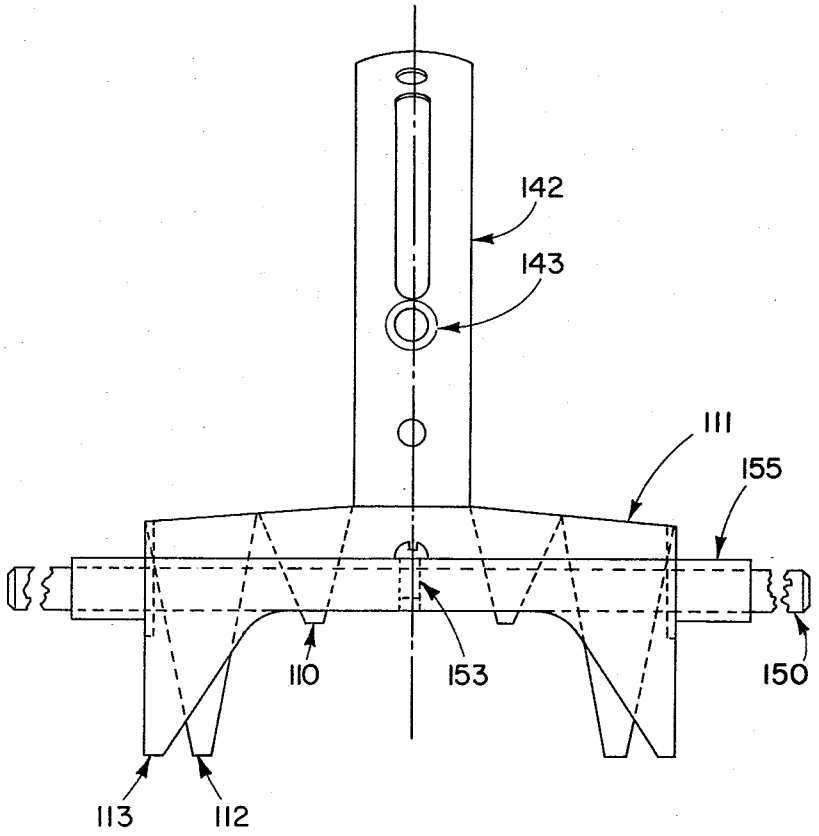
FIG. 12 is a rear view.

Referring now to FIG. 9 there is shown the crampon/binding assembly of the preferred embodiment in the open or disengaged position from the boot. An optional accessory piece is shown in this view. A heel crampon attachment 118 is shown which is primarily used for extended walking over hard snow or ice without the snowshoe attached. This heel crampon assembly 118 is designed so that it can be attached and removed without the separation of heel band loop 120, as more particularly described below.

Accessory crampon 118 can be placed on heel band 120 by removing bolt 117, sliding the heel band through lanced slots on the heel crampon and then replacing bolt 117. The alternate design of the preferred embodiment for heel crampon 118 contains an additional horizontal slot—connecting two vertical slots—through which heel band 120 passes. This configuration allows heel crampon 118 to be slipped onto the heel band 120 without the necessity of removing bolts 117 or otherwise dismantling the heel band loop 120, as is more completely described with respect to FIGS. 14, 15, and 16.

Figure 16:
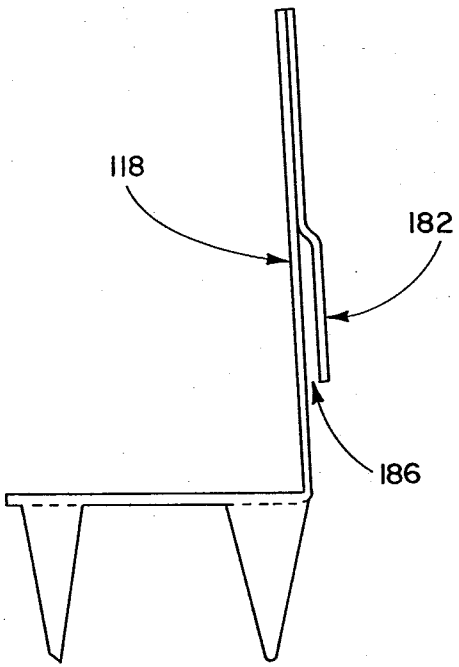
FIG. 15 is a front view and FIG. 16 is a side view of the heel crampon.
Figure 14:
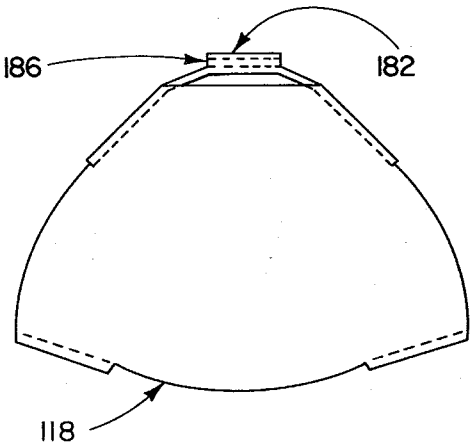
FIG. 14 is a top view.
Figure 15:
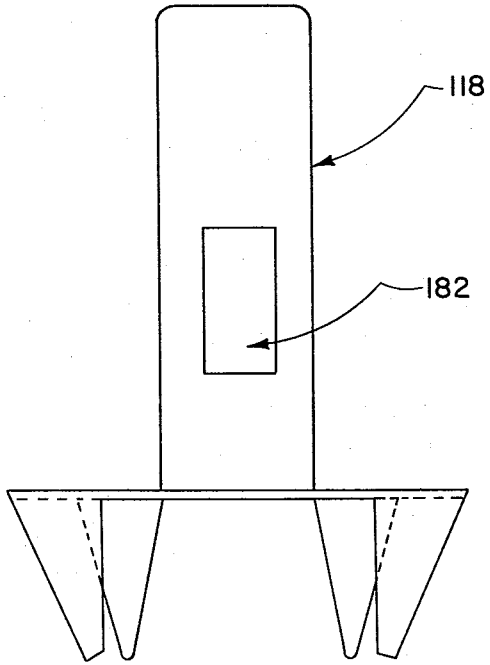

Referring now to FIGS. 14, 15 and 16 there is shown a top, front and side view, respectively, of the heel crampon assembly of the preferred embodiment. Note that an attachment loop 182 is formed on the back of the heel crampon assembly. Attachment loop 182 is formed such that there is an opening 186 in the loop assembly. The material also has a spring characteristic. By slipping opening 186 over heel band 120 one may attach and remove the heel crampon assembly 118 without the necessity of dismantling or otherwise creating a discontinuity in the heel band loop to attach the heel crampon. The heel crampon assembly 118 may be constructed of high strength steel alloy for the preferred embodiment. An alternate embodiment is to make the slot without the horizontal connecting slot for a more permanent attachment.

Figure 20:
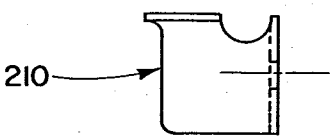
FIG. 20 is a side view of the toe clip of the preferred embodiment.
Figure 17:
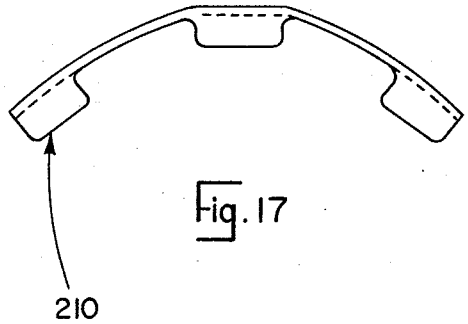
FIG. 17 is a top view.
Figure 18:
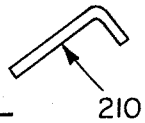
FIG. 18 is an end view.
Figure 19:
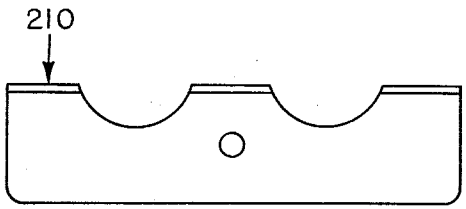
FIG. 19 is a front view.

Referring now to FIG. 17 which is a top view, FIG. 19 which is a front view and FIG. 20 which is a side view of the toe clip 210 of the preferred embodiment as shown. Note that tabs 212 are provided and that the toe clip is constructed of soft steel so that it may be bent to accommodate the various shapes of boot toes.

Figure 22:
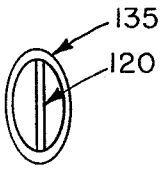
Figure 21:
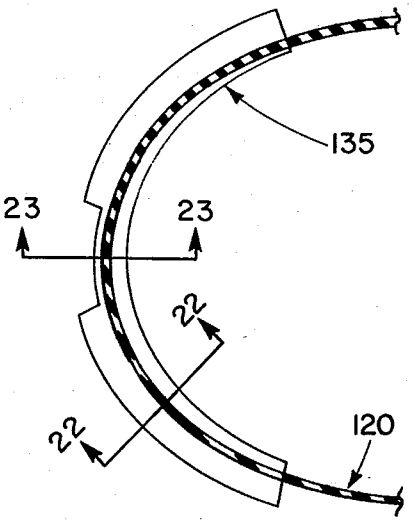
FIG. 21 is a plan view of the rear portion of the heel band of the preferred embodiment with the rubber friction band in place.

FIG. 21 shows a plan view of the rear portion of the heel band 120 with a piece of tubing 135 made of a high coefficient of friction material, such as neoprene or gum rubber, slipped over heel band 120 as indicated. A typical cross-section after tubing 135 is in place is shown in FIG. 22. The purpose of this high friction material is to prevent a slight lateral slipping of the boot heel when under a twisting force. The polished surface of heel band 120 may not restrain this movement even when tightened. (These figures do not show tubing 135 in the tightened or compressed configuration).

Figure 24:
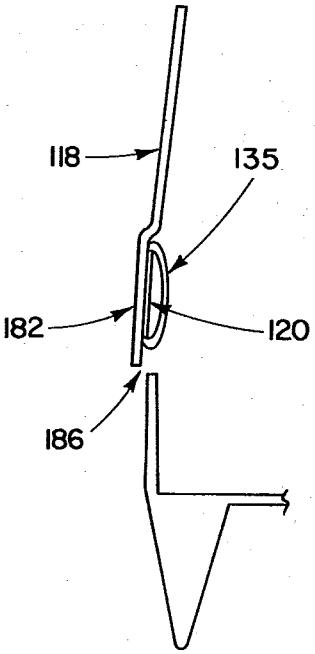
FIG. 24 is a cutaway side view of the rear heel band with the rear crampon in position.
Figure 23:
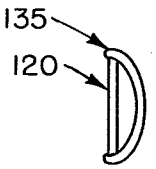
FIGS. 22 and 23 are sectional views of the rear heel band.

FIG. 22 shows a portion of tubing 135 cut out at the center area. FIG. 23 shows a sectional view through the area cut away. The purpose of this removed section is illustrated in FIG. 24 which shows the application wherein heel crampon 118 is being used without the snowshoes. The sectional view of FIG. 24 shows the heel crampon 118 in position for use.

The attachment process is accomplished by inserting the upper end of heel crampon 118 between heel band 120 and tubing 135, at the cut-away section, and forcing said crampon upward until it reaches the bottom. At this point the direction is reversed and the heel band 120 is slid into place through slot 186 in heel crampon 118. The tubing 135 also serves to retain heel crampon 118 snugly in place. The placement of heel crampon 118 has been described previously.

I claim:

1. Apparatus for attaching to a boot, or the like, said apparatus comprising:

first loop means for encircling a portion of a boot;

second means coupled to said first loop means for causing said first loop means to move and tighten about the encircled portion of said boot in response to the movement of said second means; and locking means coupled to said second means for causing said first loop means to remain in a preselected relative position in response to the movement of said second means to a predetermined locking position.

2. Apparatus as in claim 1 and further comprising adjustment means coupled to said first loop means for varying the effective length of said loop means in response to manifestations indicating that a longer or shorter loop is desired.

3. Apparatus as in claim 2 and further comprising a locking means coupled to said second means for locking with said second means when in a first relative position with respect to said second means and for releasing said second means from the locking position in response to a predetermined directional force applied thereto.

4. Apparatus as in claim 3 wherein said second means comprises substantially a second loop coupled to said first loop means; and said locking means comprises a curved member having a bias force applied thereto which gradually engages with increasing resistance as said second loop is rotated about a predetermined axis into further engagement therewith until an interlocking position is reached.

5. Apparatus in claim 4 wherein said curved member unlocks from said second loop in response to a directional force applied thereto.

6. Apparatus as in claim 3 and further comprising toe crampon means having toothlike projections extending therefrom coupled to said loop means for fitting substantially against the sole of said boot and engaging the surface being traversed.

7. Apparatus as in claim 6 and further comprising heel crampon means having toothlike projections coupled to said first loop means for abutting against the heel portion of said boot and engaging the surface being transversed.

8. Apparatus as in claims 7 and further comprising an interlocking means coupled to said loop means for engaging said apparatus for attaching a boot to a snowshoe.

9. Apparatus as in claim 8 wherein said snowshoe comprises a large planar structure having an opening defined in substantially the central portion thereof whereby the apparatus for attaching to a boot pivoting about the point of engaging of said interlocking means with said snowshoe.

* * * * *